US012366135B2

(12) United States Patent
Jacob

(10) Patent No.: US 12,366,135 B2
(45) Date of Patent: Jul. 22, 2025

(54) METHOD AND APPARATUS FOR A PLUG INCLUDING A RADIAL AND COLLAPSIBLE GAP WITHIN THE CONTINUOUS EXPANDABLE SEALING RING

(71) Applicants: Robert Jacob, Blois (FR); Régine Jacob, Blois (FR)

(72) Inventor: Gregoire Max Jacob, Houston, TX (US)

( * ) Notice: Subject to any disclaimer, the term of this patent is extended or adjusted under 35 U.S.C. 154(b) by 0 days.

(21) Appl. No.: 18/105,877

(22) Filed: Feb. 5, 2023

(65) Prior Publication Data

US 2023/0184056 A1 Jun. 15, 2023

Related U.S. Application Data

(63) Continuation-in-part of application No. 17/892,015, filed on Aug. 19, 2022, now Pat. No. 11,761,297, (Continued)

(51) Int. Cl.

| | |
|---|---|
| ***E21B 33/134*** | (2006.01) |
| ***E21B 19/24*** | (2006.01) |
| ***E21B 23/01*** | (2006.01) |
| ***E21B 23/04*** | (2006.01) |
| ***E21B 23/06*** | (2006.01) |
| ***E21B 33/124*** | (2006.01) |

(Continued)

(52) U.S. Cl.

CPC ..... *E21B 33/134* (2013.01); *E21B 19/24* (2013.01); *E21B 23/01* (2013.01); *E21B 23/06* (2013.01); *E21B 33/124* (2013.01); *E21B 33/128* (2013.01); *E21B 33/1285* (2013.01); *E21B 33/129* (2013.01); *E21B 33/1293* (2013.01); *E21B 23/04* (2013.01); *E21B 23/0411* (2020.05); *E21B 33/1292* (2013.01); *E21B 2200/08* (2020.05)

(58) Field of Classification Search

CPC ..... E21B 33/134; E21B 19/24; E21B 23/01; E21B 23/06; E21B 33/124; E21B 33/128; E21B 33/1285; E21B 33/129; E21B 33/1293; E21B 23/04; E21B 23/0411; E21B 33/1292; E21B 2200/08; E21B 33/1291; E21B 23/0413

See application file for complete search history.

(56) References Cited

U.S. PATENT DOCUMENTS

| | | | |
|---|---|---|---|
| 2,331,532 | A | 8/1940 | Bassinger |
| 5,131,468 | A | 7/1992 | Lane et al. |

(Continued)

*Primary Examiner* — Tara Schimpf
*Assistant Examiner* — Neel Girish Patel
(74) *Attorney, Agent, or Firm* — Blair B. Suire

(57) ABSTRACT

A plug assembly includes a continuous expandable sealing ring having an embedded radial gap feature. The continuous expandable sealing ring includes a first section with a prominent external surface, whereby the first section with a prominent external surface includes a radial gap underneath, and a second section with a second external surface. During the setting of the plug, the first prominent external surface comes in contact with the internal surface of the tubing string, while the radial gap underneath allows avoiding transmitting radial forces from the continuous sealing ring towards the tubing string, therefore keeping the majority of the force transmission from the expandable gripping ring towards the tubing string.

19 Claims, 11 Drawing Sheets

Related U.S. Application Data which is a continuation of application No. 17/275,509, filed on Mar. 11, 2021, now Pat. No. 11,879,303.

(51) Int. Cl.
*E21B 33/128* (2006.01)
*E21B 33/129* (2006.01)

(56) References Cited

U.S. PATENT DOCUMENTS 5,819,846 A 10/1998 Bolt, Jr.
5,984,007 A 11/1999 Yuan et al.
6,220,349 B1 4/2001 Vargus et al.
6,394,180 B1 5/2002 Berscheidt
7,475,736 B2 1/2009 Lehr et al.
7,510,018 B2 3/2009 Williamson
8,579,024 B2 11/2013 Mailand et al.
8,684,096 B2 4/2014 Harris et al.
8,887,818 B1 11/2014 Carr et al.
8,997,859 B1 4/2015 Ackermann
9,027,655 B2 5/2015 Xu et al.
9,027,659 B2 5/2015 Martinez et al.
9,062,543 B1 6/2015 Snider et al.
9,080,403 B2 7/2015 Xu et al.
9,284,803 B2 3/2016 Stone et al.
9,309,733 B2 4/2016 Xu et al.
9,316,084 B2 4/2016 Carter et al.
9,316,086 B2 4/2016 Van Lue
9,382,787 B2 7/2016 Naedler
9,732,579 B2 8/2017 Hiorth et al.
9,752,407 B2 9/2017 Jacob
9,835,003 B2 12/2017 Harris
9,976,381 B2 5/2018 Martin et al.
9,988,867 B2 6/2018 Jacob et al.
10,066,453 B2 9/2018 Silva
10,385,651 B2 * 8/2019 Smith ..... E21B 23/01
10,408,012 B2 9/2019 Martin et al.
10,472,927 B2 11/2019 Marcin et al.
10,508,526 B2 12/2019 Ring
10,648,275 B2 5/2020 Dirocco
10,662,732 B2 5/2020 Frazier
10,724,311 B2 7/2020 Parekh et al.
10,794,142 B2 10/2020 Stone et al.
11,002,104 B2 5/2021 Wolf et al.
11,021,927 B2 6/2021 Hiorth
11,047,186 B2 6/2021 Ng et al.
11,072,991 B2 7/2021 Martin et al.
11,125,045 B2 9/2021 Hern et al.
11,274,525 B2 3/2022 Kratochvil
11,396,787 B2 7/2022 Kellner et al.
11,408,245 B2 8/2022 Dudzinski
11,428,089 B2 8/2022 Winkler et al.
11,434,717 B2 9/2022 Jacob
11,492,867 B2 11/2022 Yuan et al.
2003/0188876 A1 * 10/2003 Vick ..... E21B 33/1208 166/134
2004/0079528 A1 * 4/2004 Metcalfe ..... E21B 7/20 166/55
2013/0186647 A1 * 7/2013 Xu ..... E21B 33/129 166/207
2013/0186650 A1 * 7/2013 Xu ..... E21B 23/01 166/386
2013/0206409 A1 * 8/2013 Stone ..... E21B 43/261 166/135
2014/0262344 A1 * 9/2014 Standridge ..... E21B 33/129 166/208
2016/0047195 A1 2/2016 Snider
2016/0186511 A1 6/2016 Coronado
2016/0369582 A1 * 12/2016 Bar ..... E21B 23/02
2017/0145781 A1 * 5/2017 Silva ..... E21B 23/06
2018/0135380 A1 * 5/2018 Saulou ..... E21B 33/128
2018/0148993 A1 * 5/2018 Schmidt ..... E21B 33/1291
2018/0171748 A1 * 6/2018 Hou ..... E21B 33/1293
2018/0274325 A1 * 9/2018 Greenlee ..... E21B 33/128
2019/0106961 A1 * 4/2019 Hardesty ..... E21B 33/128
2019/0136657 A1 * 5/2019 Wroblicky ..... E21B 33/1285
2019/0203557 A1 * 7/2019 Dirocco ..... E21B 33/129
2019/0292874 A1 * 9/2019 Saeed ..... E21B 33/1293
2019/0309598 A1 * 10/2019 Cheng ..... E21B 33/128
2020/0308923 A1 * 10/2020 Roessler ..... E21B 33/12
2020/0347694 A1 * 11/2020 Power ..... E21B 33/1293
2021/0238950 A1 * 8/2021 Keeling ..... E21B 33/128
2021/0310338 A1 10/2021 Turley et al.
2021/0381334 A1 * 12/2021 Goodman ..... E21B 33/128

* cited by examiner

METHOD AND APPARATUS FOR A PLUG INCLUDING A RADIAL AND COLLAPSIBLE GAP WITHIN THE CONTINUOUS EXPANDABLE SEALING RING

CROSS-REFERENCE TO RELATED APPLICATION

The present application is a Continuation-In-Part (CIP) application of U.S. application Ser. No. 17/275,509 filed Mar. 11, 2021, titled "Methods and Apparatus for providing a plug with a two-step expansion" naming Gregoire M Jacob as inventor, and a Continuation-In-Part (CIP) application of U.S. application Ser. No. 17/892,015 filed Aug. 19, 2022, titles "Methods and Apparatus for providing a plug activated by cup and untethered object" itself a Continuation application of U.S. application Ser. No. 17/275,509 filed Mar. 11, 2021. All the foregoing applications are hereby incorporated herein by reference in their entirety.

BACKGROUND

This disclosure relates generally to methods and apparatus for providing a plug inside a tubing string containing well fluid. This disclosure relates more particularly to methods and apparatus for providing a plug including a continuous expandable sealing ring having an embedded radial gap feature.

The first figure (FIG. 1) refers to one environment example in which the methods and apparatus for providing a plug inside a tubing string containing well fluid, described herein, may be implemented and used.

FIG. 1 illustrates a typical cross section of an underground section dedicated to a cased-hole operation. The type of operation is often designated as Multi-Stage-Stimulation, as similar operations are repeatedly performed inside a tubing string in order to stimulate the wellbore area.

The wellbore may have a cased section, represented with tubing string 1. The tubing string contains typically several sections from the surface 3 until the well end. The tubing string represented schematically includes a vertical and horizontal section. The entire tubing string contains a well fluid 2, which can be pumped from surface, such as water, gel, brine, acid, and also coming from downhole formation such as produced fluids or condensates, like water and hydrocarbons in liquid or gas form.

The tubing string 1 can be partially or fully cemented, referred as cemented stimulation, or partially or fully free within the borehole, referred as open-hole stimulation. Typically, a stimulation will include temporary or permanent section isolation between the formation and the internal volume of the tubing string.

The bottom section of FIG. 1 illustrates several stimulation stages starting from well end. In this particular well embodiment, at least stages 4*a*, 4*b*, 4*c* have been stimulated and isolated from each other. The stimulation is represented with fluid penetration inside the formation through fracturing channels 7, which are initiated from a fluid entry point inside the tubing string. This fluid entry point can typically come from perforations or sliding sleeves openings.

Each isolation includes a set plug 6 with its untethered object 5, represented as a spherical ball as one example.

The stimulation and isolation are typically sequential from the well end, from downhole to uphole. At the end of stage 4*c*, after its stimulation 7, another isolation and stimulation, represented as subsequent stage 4*d*, may be performed in the tubing string 1.

In this representation, a toolstring 10 is conveyed via a cable or wireline 9, which is controlled by a surface unit 8. Other conveyance methods may include tubing conveyed toolstring or coiled tubing. Along with a cable, a combination of gravity, tractoring and pump-down may be used to bring the toolstring 10 to the desired position inside the tubing string 1. The toolstring 10 may convey an unset plug 11, dedicated to isolating stage 4*c* from stage 4*d*.

Additional pumping rate and pressure may create a fluid stimulation 7 inside the formation located on or near stage 4*d*. When the stimulation is completed, another plug may be set and the overall sequence of stages 4*a* to 4*d* may start again. Typically, the number of stages within a wellbore may be between 10 and 100, depending on the technique used, the length of the well and spacing of each stage.

There is a continuing need in the art for methods and apparatus for methods and apparatus for providing a plug inside a tubing string containing well fluid. Preferably, the plug is provided using a 2-step ball contact, first with one or more deformable plug components, second with one or more rigid plug components.

BRIEF DESCRIPTION OF THE DRAWINGS

For a more detailed description of the embodiments of the disclosure, reference will now be made to the accompanying drawings.

DETAILED DESCRIPTION

It is to be understood that the following disclosure describes several exemplary embodiments for implementing different features, structures, or functions of the invention. Exemplary embodiments of components, arrangements, and configurations are described below to simplify the disclosure; however, these exemplary embodiments are provided merely as examples and are not intended to limit the scope of the invention.

A reference to U.S. application Ser. No. 17/275,509 filed Mar. 11, 2021, titled "Methods and Apparatus for providing a plug with a two-step expansion" can provide a detailed description of the FIGS. 1-5. A reference to U.S. application Ser. No. 17/892,015 filed Aug. 19, 2022, titled "Methods and Apparatus for providing a plug activated by cup and untethered object" can provide a detailed description of the FIG. 6. A quick background reference is done in this US application, as several embodiments are the same compared to the new US application as CIP with the improvement further described in FIGS. 6 to 17.

Figure 2:
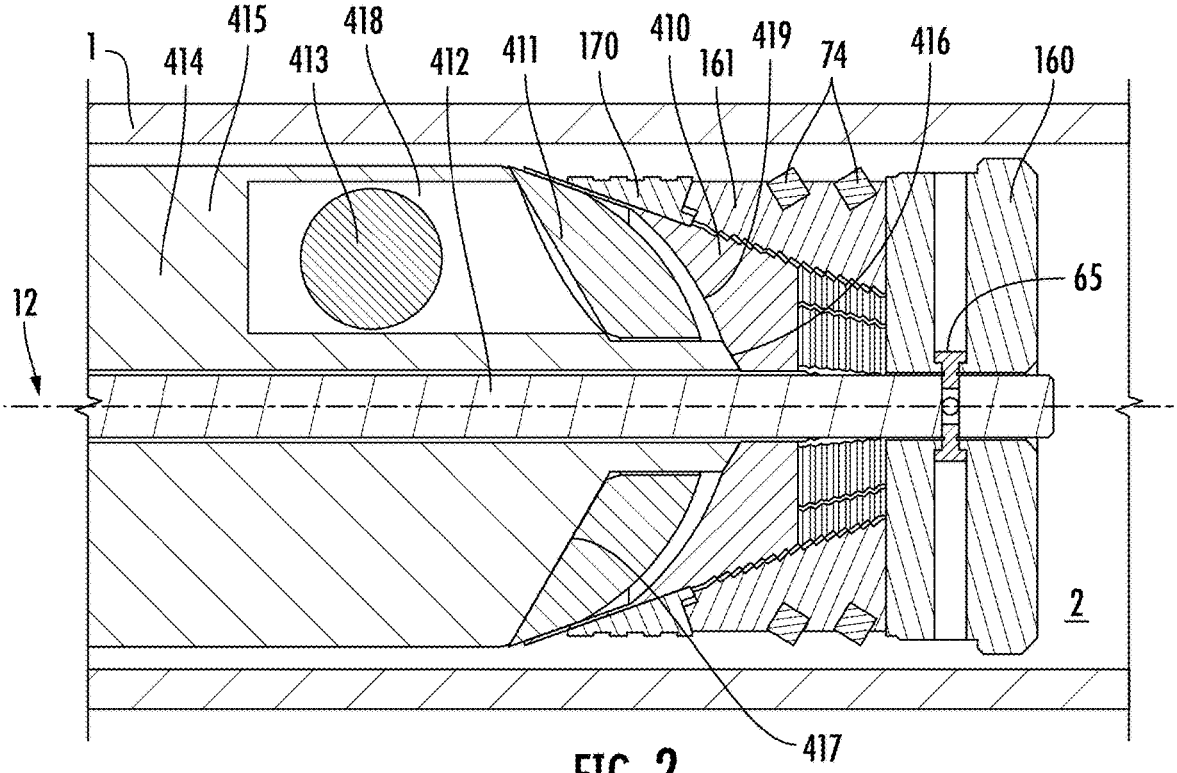
FIG. 2 is a cross-section view of an embodiment of a plug assembly, in a run-in hole position inside a tubing string, over a setting tool having a caged untethered object or ball-in-place.

FIG. 2 represents a cut view of an unset plug or run-in-hole plug, inside the tubing string 1, along a tool axis 12. FIG. 2 represents the unactuated or undeformed position for the plug and a retrievable setting tool, which allows traveling inside the tubing string 1.

The plug may include the following components:

- an expandable continuous seal ring 170,
- an expandable gripping ring 161, which preferably includes anchoring devices 74,
- a back-pushing ring 160, including shear devices 65 which may be positioned on the inner diameter of the back-pushing ring 160,
- a locking ring 410, which includes a conical external shape matching the inner surface of the expandable gripping ring 161 and the inner surface of the expandable continuous seal ring 170. The locking ring 410 may include a hemispherical inner surface 419 and a conical inner surface 416, and,
- a hemispherical cup 411.

The retrievable setting tool may include the following components:

- an external mandrel 414, which may include a cylindrical pocket 418. The pocket 418 may have a channel 415 linking the pocket 418 with the well fluid 2 present inside the tubing string 1. In this representation, the external mandrel 414 may contact the locking ring 410 along the conical surface 416. In addition, the external mandrel 414 may contact the hemispherical cup 411 along a conical surface 417,
- a rod 412 which can move longitudinally relative to the external mandrel 414. The rod 412 may provide a link to the shear devices 65, securing the longitudinal position of the back-pushing ring 160.

In addition, an untethered object 413 may be included inside the pocket 418 of the external mandrel 414.

This embodiment may be referred to as 'ball in place', where the untethered object 413 may be a ball which is included in the retrievable setting tool. Other embodiments for the untethered object 413 may be a pill, a dart, a plunger, preferably with at least a hemispherical or a conical shape.

Figure 3:
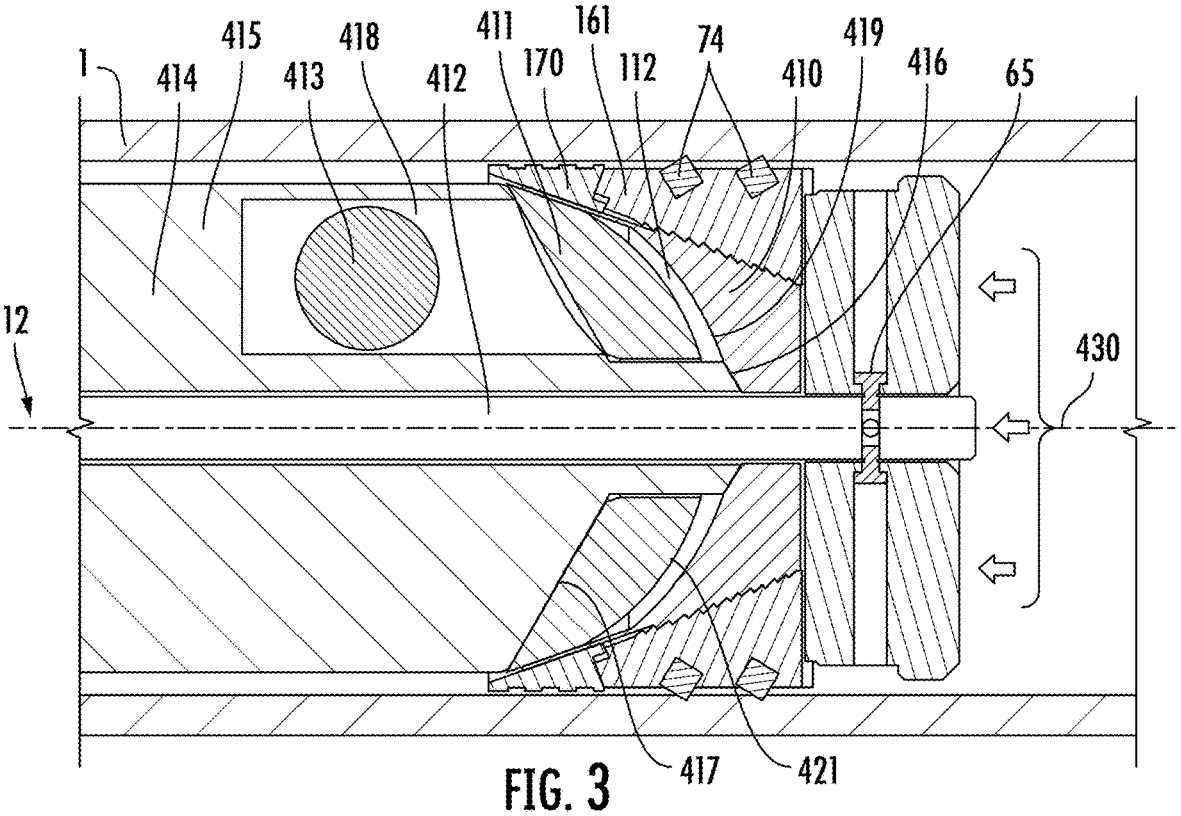
FIG. 3 is a cross-section view of a plug assembly, in a set position inside a tubing string, over a setting tool having a caged untethered object or ball-in-place.

FIG. 3 represents a sequential step of FIG. 2. In FIG. 3, the retrievable setting tool has been actuated, which induces the longitudinal movement indicated by arrow 430 of the rod 412 relative to the external mandrel 414.

Through the connection of the shear devices 65 with the rod 412, the movement of the rod 412, indicated by arrow 430, may induce the same longitudinal movement as the back-pushing ring 160. The back-pushing ring may induce in turn an expansion movement to the expandable gripping ring 161, which in turn induces an expansion movement through the deformation of the continuous expandable seal ring 170. The expansion of the expandable gripping ring 161 and of the continuous expandable seal ring 170 occurs both longitudinally and radially over the conical external shape of the locking ring 410. The locking ring may be held longitudinally in position thanks to the contact 416 with the external mandrel 414, and may be held radially in position through the conical contact with the hemispherical cup 411, itself held in position through the conical contact 417 with the external mandrel or centered around the internal rod 142. To be noted during this expansion process, the hemispherical surface 419 of the locking ring 410 may not come in contact with the hemispherical surface 421 of the hemispherical cup 411, in-between keeping a longitudinal gap 112.

The expansion process of the expandable gripping ring may end when one of the anchoring devices 74 start penetrating inside the inner surface of the tubing string 1, and a force equilibrium is established between the anchoring force or friction force created by penetrating the anchoring devices 74 inside the tubing string 1, relative to the holding resistance of the shear devices 65.

At this point, the expandable continuous seal ring 170 might not be in continuous contact with the inner surface of the tubing string 1. This can be due to the geometry of the parts or possible elastic restraint effect of the expanded parts including the expandable continuous sealing ring 170.

As depicted in FIG. 3, the untethered object 413 may still remain inside the cylindrical pocket 418 of the external mandrel 414.

The hemispherical cup 411 may stay in its longitudinal position thanks to the friction contact along its conical surface 420 in common with the inner conical surface of the locking ring 410, or thanks to a clipping mechanism with the locking ring 410.

Figure 4:
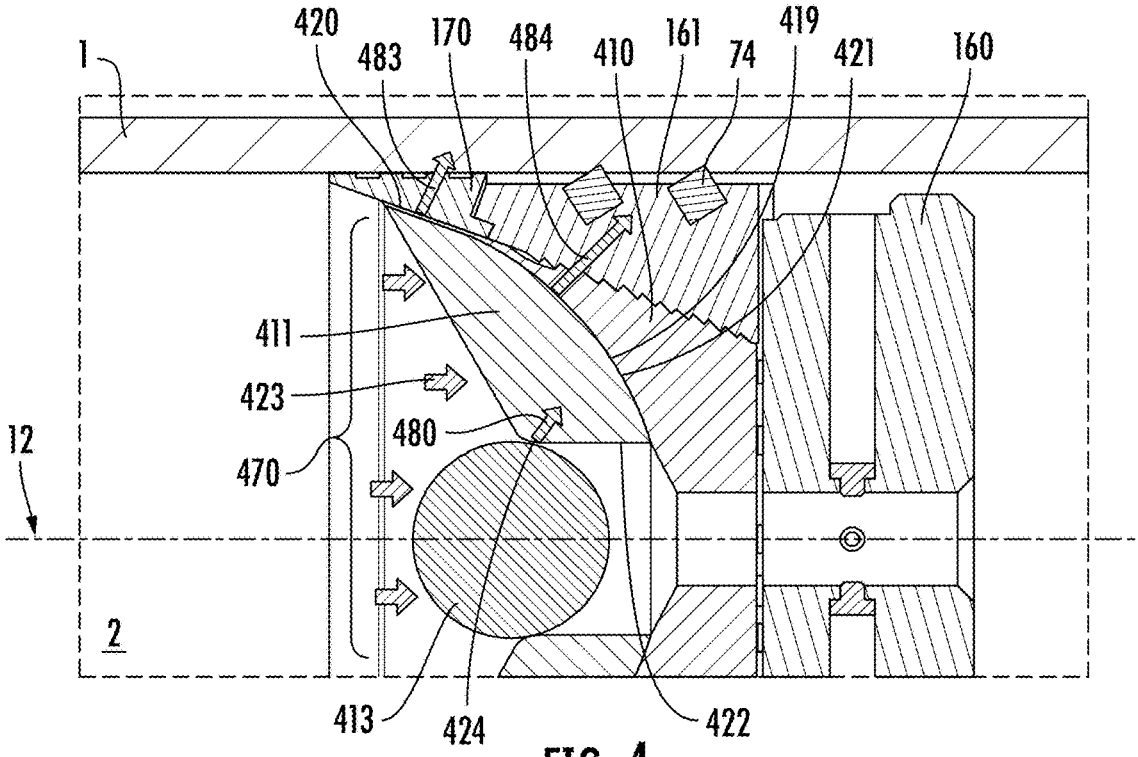
FIG. 4 is a detailed cross-section view of a plug assembly, in a set position, with the caged untethered object landed on the hemispherical cup and pressing on the plug assembly using well fluid pressure.

FIG. 4 depicts a close-up view of a plug assembly, in a set position, with the caged untethered object landed on the hemispherical cup and pressing on the plug assembly using well fluid pressure.

As depicted in FIG. 4, the untethered object 413 has landed on the hemispherical cup 411 and may contact the seating surface 424, represented as a chamfer.

The well fluid 2 may be pumped downhole across the set plug, creating a flow restriction and in turn a local pressure uphole of the set plug. The local pressure, uphole of the set plug, may create a force on the uphole surfaces exposed to the well fluid pressure, and symbolized with arrows 470. As representing the largest surface area exposed to the uphole local fluid pressure, the force 470 may act mainly on the untethered object 413 and on the hemispherical cup 411.

As depicted in FIG. 4, the force 470 may induce a further longitudinal movement of the hemispherical cup 411 and the untethered object 413, by closing the longitudinal gap, depicted in FIG. 3. The longitudinal movement of the hemispherical cup may in turn create a radial deformation of the locking ring 410 through its inner conical surface 420, which in turn may create a further radial deformation of the expandable continuous seal ring 170.

The further longitudinal movement may continue up to surface contact of the hemispherical surface 421 of the hemispherical cup 411 together with the corresponding surface 419 on the locking ring 410, therefore closing the longitudinal gap 112, depicted in FIG. 3.

The force 470 is acting on the untethered object 413 and on the hemispherical cup 411, with the two parts being in contact through a chamfer 424 and providing a force indicated by arrow 480 at this contact surface. The resultant force indicated by arrow 481 of these two parts may be directed perpendicular to the conical contact surface 420 with the locking ring 410.

The expandable gripping ring 161 secured with the anchoring devices 74 inside the tubing string 1 and locked internally by the locking ring 410, may not deform during the further expansion process of the expandable continuous ring 170, and provide a radial sliding guide.

Having the hemispherical cup 411 in contact with the locking ring 410, therefore closing the longitudinal gap 112, the resultant of the force 470 on the untethered object 413 and on the hemispherical cup 411, may now directed towards forces 483 and 484. Force 483 may compress the expandable continuous seal ring 170 further towards the tubing string, possibly enhancing the sealing feature of the plug. Force 484 may compress the expandable gripping ring 161 further towards the tubing string via the anchoring devices 74, possibly enhancing the anchoring feature of the plug.

Figure 5:
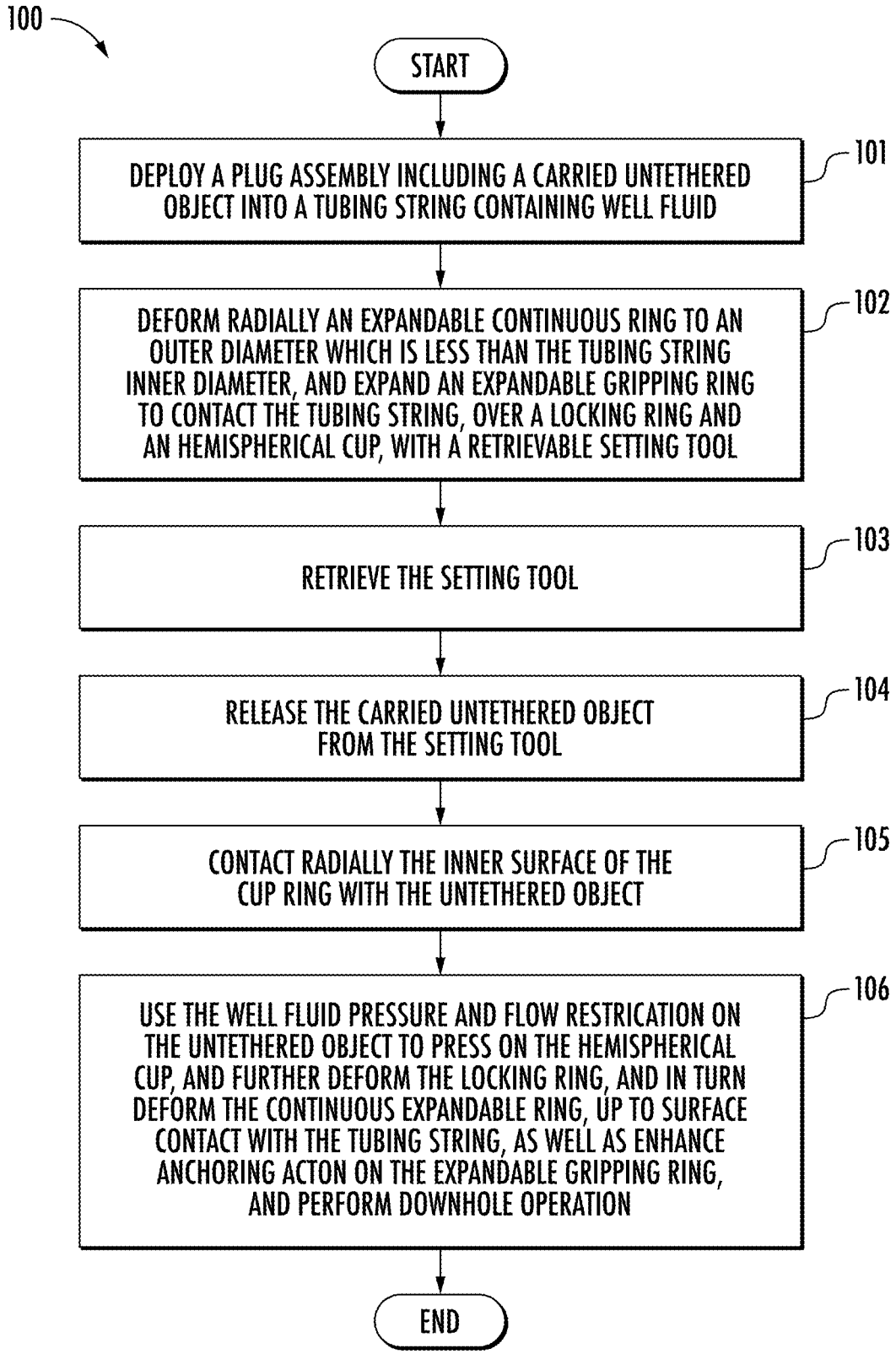
FIG. 5 is a flow diagram representing a technique sequence of deploying a plug assembly with a caged untethered object and hemispherical cup having the action of further expanding the expandable assembly and contacting a stopping surface on the locking ring.

FIG. 5 represents a technique sequence 100, which includes major steps depicted in FIG. 2 to FIG. 4.

Step 101 corresponds to the deployment of a plug assembly (170, 410, 411, 161, 160) including a carried untethered object (413) into the tubing string (1) containing well fluid (2). During step 102, the plug assembly is expanded radially, including the radial deformation of the continuous seal ring (170), and the radial expansion of the expandable gripping ring (161), with the action of a retrievable setting tool, over a locking ring (410) and hemispherical cup (411). During the same step 102, the expandable gripping ring (161) contacts at least one point of the inner surface of the tubing string (1), while the expandable continuous seal ring (170) is deformed to an outer diameter which may be less than the tubing string (1) inner diameter. Then, during step 103, the retrievable setting tool, is retrieved. Further during step 104, the carried untethered object (413), is released from the setting tool. Then, during step 105, the untethered object (413) contacts radially the inner surface of the hemispherical cup (411). Then, during step 106, the well fluid (2) pressure and flow restriction uphole of the untethered object (413) and hemispherical cup (411) is used to act as a force to deform further the expandable continuous seal ring (170), up to its outer surface contact with the tubing string (1) inner surface, allowing further enhanced contact between all plug components from the untethered object (413) to the tubing string (1) passing through the hemispherical cup (411), the locking ring (410) and the expandable continuous seal ring (170). The same force may also enhance the anchoring action on the expandable gripping ring (161). This isolation state allows performing a downhole operation inside the well.

In some embodiments, the method may comprise the step of diverting a portion of the well fluid outside the tubing string, or the step of sealing a portion of the well fluid inside the tubing string with the plug assembly. The method may comprise the step of dissolving at least one component of the plug assembly, the cup, or the untethered object.

Figure 6:
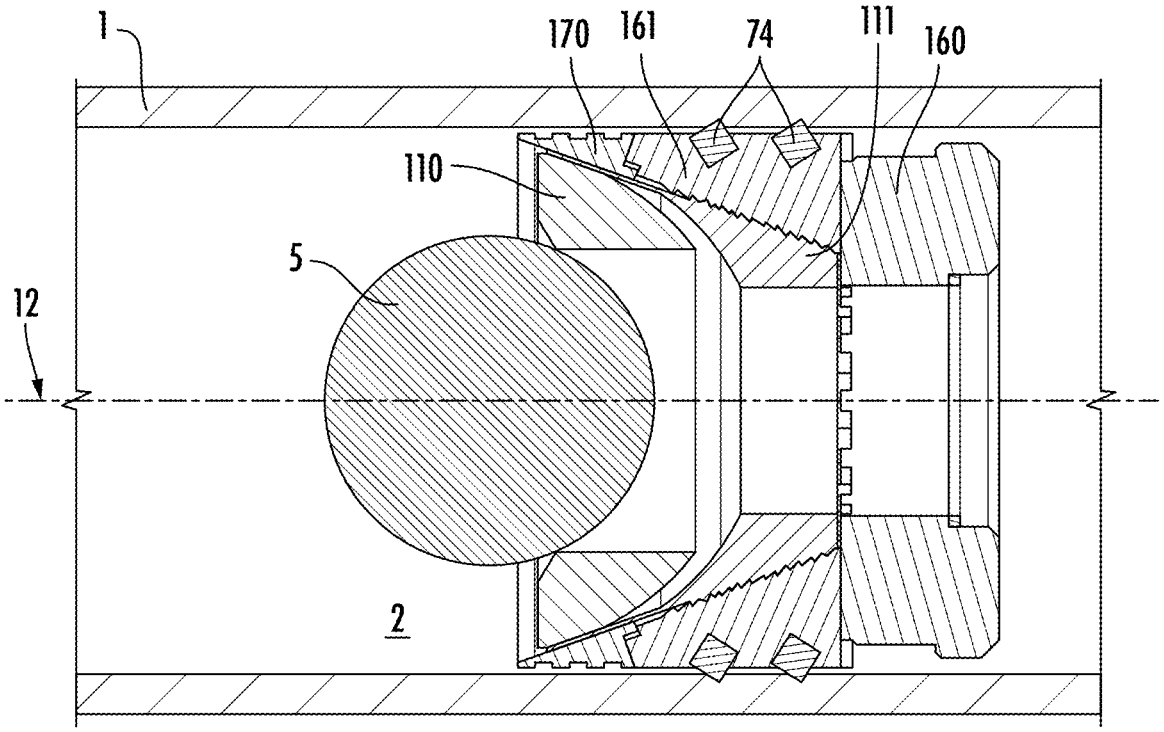
FIG. 6 is a cross-section view of a ball-in-place plug, activated by a cup. The plug is depicted in set position inside a tubing.

FIG. 6 represents a variation of the plug depicted in FIGS. 2-5, whereby a hemispherical cup 110 includes a larger inner diameter compared to the cup 411 of FIGS. 2-5. The hemispherical cup 110 may allow to seat a larger untethered object 5. The plug of FIG. 6 would be more suited for ball-drop operation, whereby the untethered object 5 is released from surface, rather than from inside the tool string 10.

FIGS. 7 to 12 depict an embodiment for a plug including a radial and collapsible gap within the continuous expandable sealing ring.

Figure 7:
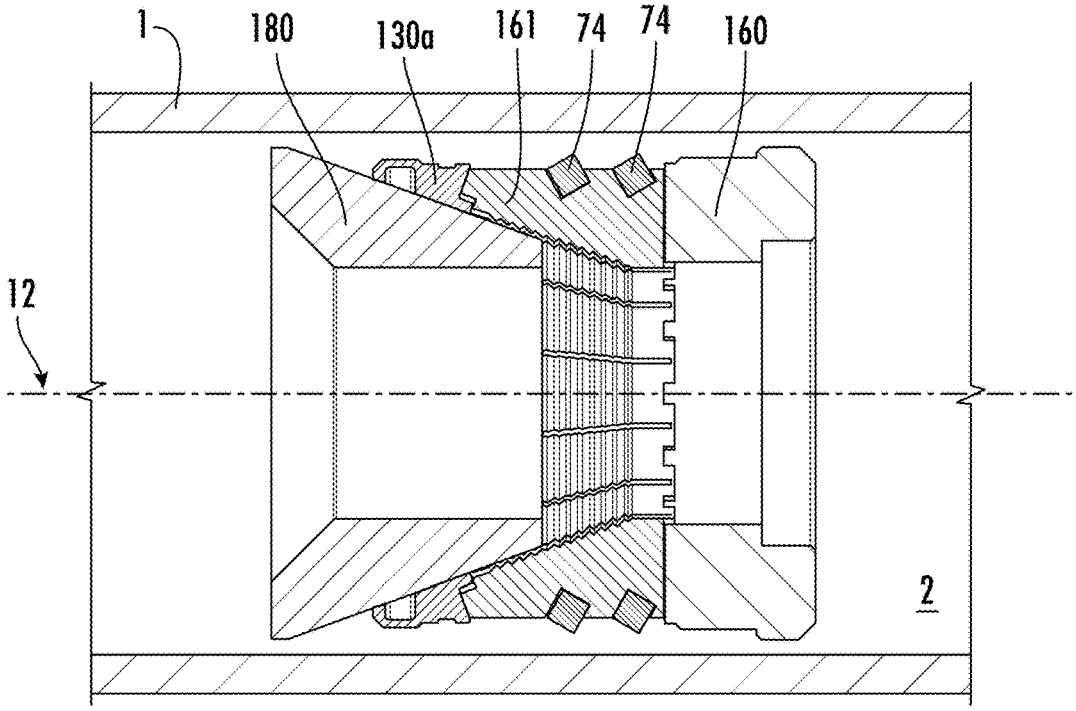
FIG. 7 is a cross-section view of a plug including a radial and collapsible gap within the continuous expandable sealing ring, as run-in-hole position.

FIG. 7 represents a cross-section view of a plug, in an unset or conveying position, within a tubing string 1 filled with well fluid 2. The plug may comprise the following components:

- an expandable continuous sealing ring 130,
- an expandable gripping ring 161, which may include one or more anchoring devices, represented as buttons 74,
- an integral locking ring 180,
- a back-pushing ring 160.

The continuous expandable sealing ring 130 may include additional features compared to prior disclosures in related US patent applications as cross-references, as item 170. Details regarding the continuous expandable sealing ring 130 will be depicted in future figures, in particular in FIGS. 10, 12, 13 and 14. In an unset position, or undeformed position, the continuous expandable sealing ring 130 is referred as 130*a*.

The descriptions made in U.S. application Ser. No. 17/275,509 filed Mar. 11, 2021 for the expandable gripping ring 161, the anchoring devices 74, the back-pushing ring 160, can be taken as reference for this current CIP application.

The integral locking ring 180 can be considered as the combination of the locking ring 111 and hemispherical cup 110 into an integral part. The integral locking ring 180 may therefore not include the function of the longitudinal gap 112 which may be present when considering the combination of two parts 110 and 111.

All the plug components, 130, 161, 74, 160, 180, including the untethered object 22 may be built out of dissolvable material. The dissolvable material may be a metallic alloy, a plastic alloy or a composite material which may dissolve or decompose within the well fluid 2 over time. The dissolving or decomposition may include an oxidation-reduction or corrosion reaction with some components of the well fluid 2. Some environmental conditions may influence the dissolving of some of the plug dissolving components, such as the well fluid 2 temperature, pressure, salinity, pH, density, movement, gas/fluid/solid content proportions, and chemical composition. The plug components may include different types of dissolving materials, which may have different dissolving rate and different mechanical properties, such as yield strength, ductility, hardness, based on the function within the plug. Coatings and heat treatment may also influence dissolving rate and mechanical properties of the different type of dissolving materials. Within the same part, multiple materials with different properties, such as mechanical or dissolving, may be used.

Figure 1:
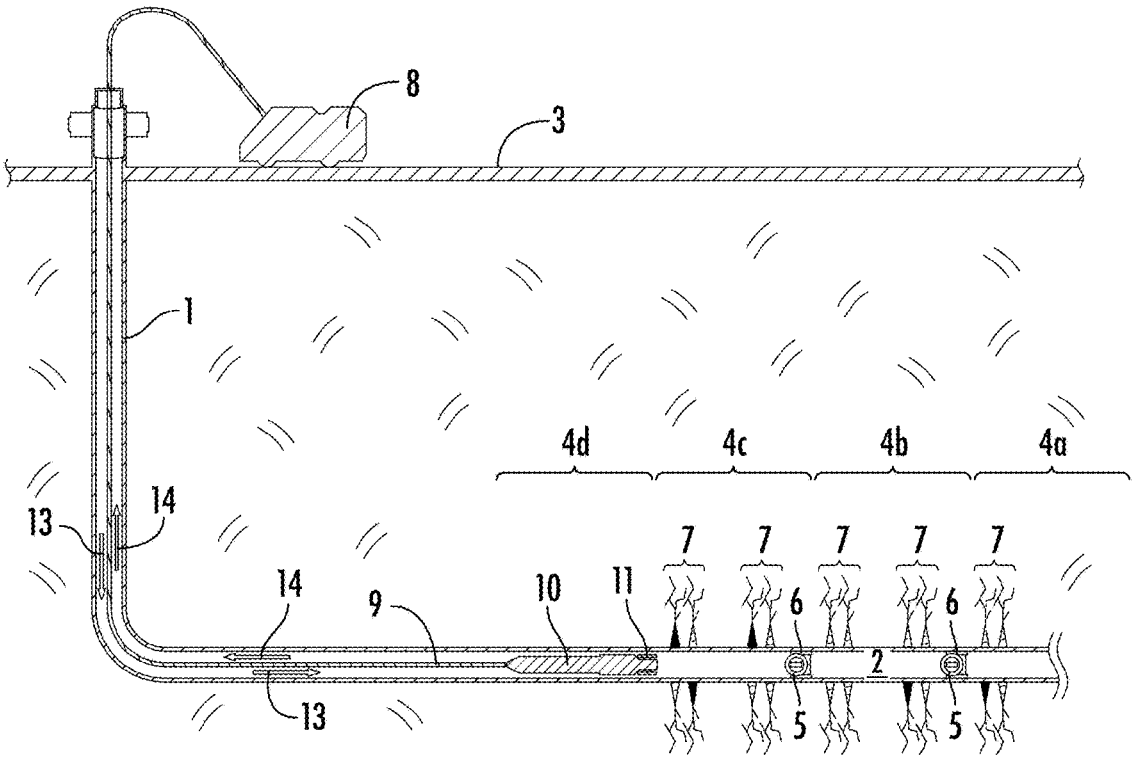
FIG. 1 is a wellbore cross-section view of typical Multi-Stage-Stimulation operation ongoing, with three stages completed and a toolstring conveyance to install the third isolation device for the fourth stage.

The plug with the above listed components may typically be conveyed on a toolstring 10, including a setting tool and a setting adapter. The setting adapter, also known as adapter kit, may include two components, similar to the ones seen in FIGS. 2-3, namely an external mandrel 414 and an internal rod 412. The external mandrel 414 and internal rod 412 may be specific to adapt to the type of conveyed plug. The toolstring 10, as depicted in the background FIG. 1 may be conveyed via a wireline cable 9, or via a coiled-tubing or flexible tubing, or via a tractoring device, or pumped down independently from surface inside the well fluid 2. The toolstring 10 may include other measuring or actuating components, such as positioning or formation measurement devices, like CCL for Casing Collar Locator, GR for Gamma Ray, or any environment measurement such as pressure, temperature, resistivity, sonic, ultrasonic and any combination of the above. Typically, the toolstring 10 may also include perforating guns to create perforating channels, leading to fracturing channels 7, as depicted in FIG. 1. The toolstring 10 may also include a setting tool, such as an actuation tool which provides an actuation force, typically a longitudinal force, along axis 12, with the purpose to displace longitudinally the external mandrel 414 relative to the internal rod 412, or reversed. The setting tool, not shown in FIG. 7, may therefore have been connected to the external mandrel 414 and to the internal rod 412, typically through threaded or pined connections. The setting tool may provide its longitudinal actuation force through different means, such as power charge, hydrostatic downhole pressure, electric motor, turbine, embedded explosive or any combination. The setting tool may be suited to actuate or set the plug, such as the one depicted in FIG. 7, by longitudinally displacing the external mandrel 414 relative to the internal rod 412, after receiving a command to start the relative displacement. The command to start the relative displacement may come from a wired signal to an addressable switch, from an internally programmed signal inside the toolstring 10, based on a position or an RFID tag or specific environmental conditions within the tubing string 1, or from a wireless signal sent by another device within the tubing string 1, or within a nearby tubing string or within a surface device communicating with the toolstring 10.

Figure 8:
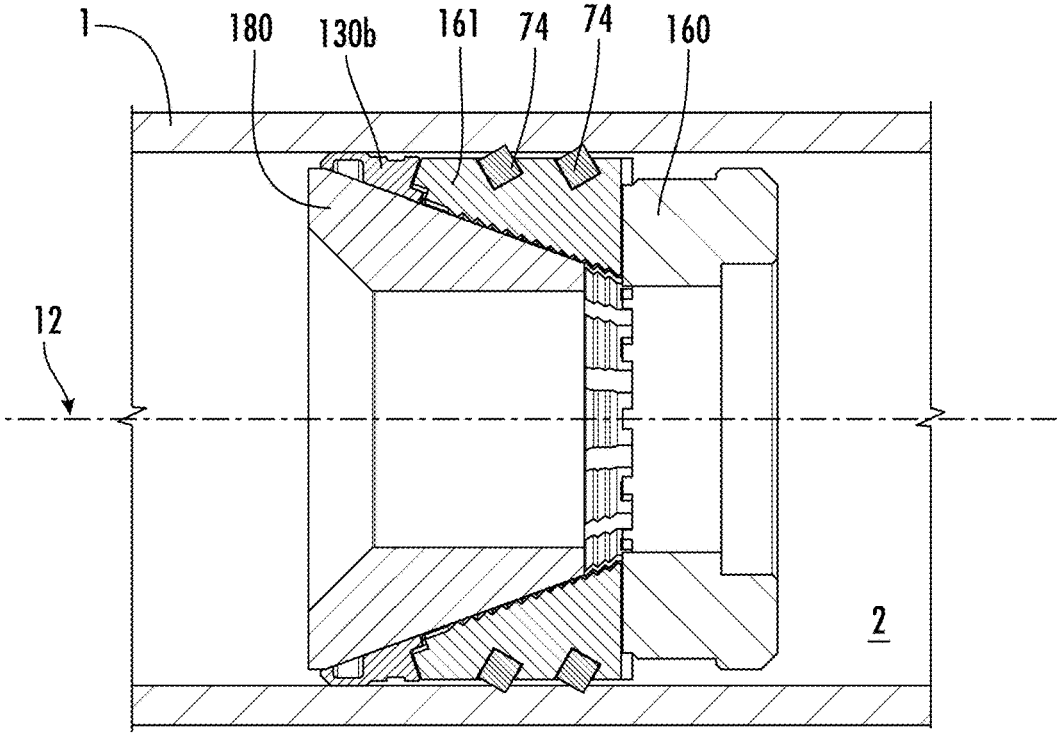
FIG. 8 is a cross-section view of the plug of FIG. 7 after set within the tubing string.

FIG. 8 represents a sequential step following the step described in FIG. 7.

FIG. 8 represents a cross-section view of the plug of FIG. 7 in a set position. To achieve a set position, the back-pushing ring 160 may have moved longitudinally relative to the integral locking ring 180, typically thanks to the force provided by the setting tool within the toolstring 10. The longitudinal movement of the back-pushing ring 160 may have induced a longitudinal movement of the expandable gripping ring 161 and the expandable continuous sealing ring 130. The longitudinal movement of the items 161 and 130 over the flared outer surface 181 of the integral locking ring 180 may in turn induce a radial expansion of the same items 161 and 130. The radial expansion of both items 161 and 130 may be stopped when the anchoring devices 74 of the expandable gripping ring 161 are contacting the internal surface of the tubing string 1. Simultaneously of the penetration of the anchoring devices 74, one external surface of the expandable continuous sealing ring 130 may contact the internal surface of the tubing string 1, as will be further depicted in FIG. 10. The expandable continuous sealing ring 130 in a set position will be referred as 130*b*.

Figure 9:
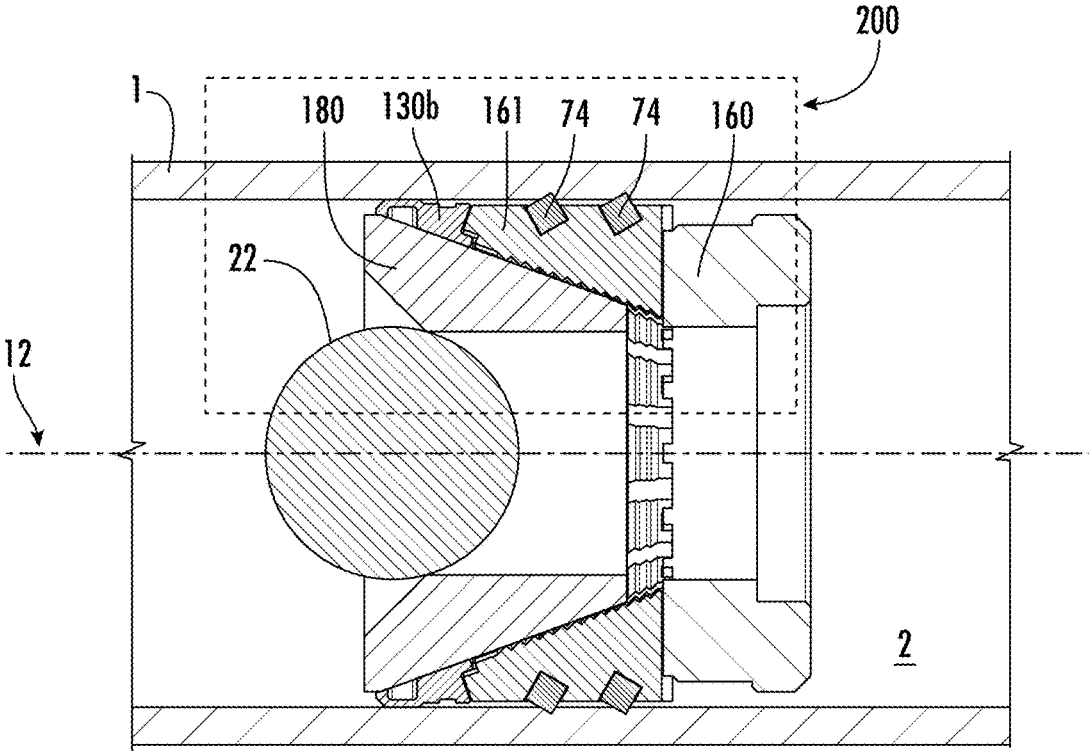
FIG. 9 is a cross-section view of the plug of FIG. 8 after set and landing of the untethered object on the integral lockring.

FIG. 9 represents a sequential step following the step described in FIG. 8. FIG. 9 represents a cross-section view of the plug of FIG. 8 in the same set position, with the addition of an untethered object 22 landed on the integral locking ring 180. At this point of representation, no further deformation of the expandable continuous sealing ring 130 and of the expandable gripping ring 161, may be observed. The expandable continuous sealing ring 130 would stay in its set position 130*b*, after the deformation induced from the setting process.

Figure 10:
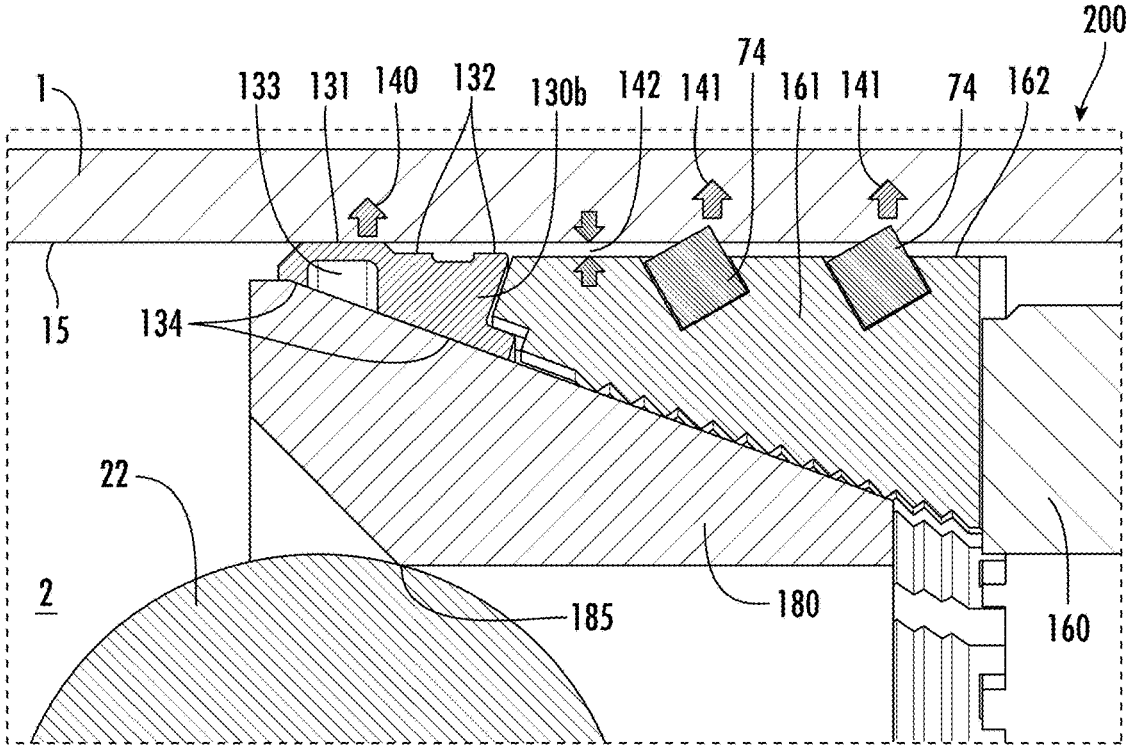
FIG. 10 is a detailed cross-section view FIG. 9.

A detailed section 200 is marked in FIG. 9 and will further be detailed in FIG. 10, including the same items for both figures.

FIG. 10 depicts the detailed section 200, as a cross-section view of the set plug of FIG. 8 with the untethered object 22 landed on the integral locking ring 180. The position of the expandable items, namely the expandable continuous sealing ring 130, depicted as 130*b*, and of the expandable gripping ring 161 may be the same as at the end of the plug setting process, as depicted in FIG. 8.

In the set position, the expandable continuous sealing ring 130, depicted as 130*b*, may be bridging between the flared outer surface 181 of the integral locking ring 180 and inner surface 15 of the tubing string 1. At the end of the deformation occurring during the setting process, the expandable continuous sealing ring 130*b* may have different surfaces in contact with other plug or tubing components. An external prominent surface 131 may come in contact with the inner surface 15 of the tubing string. The inner flared surface 134 may keep its contact with the external flared surface 181 of the integral locking ring 180. A cavity 133, as radial gap, may be positioned within the expandable continuous sealing ring 130, radially positioned under the external prominent surface 131. The remaining external surface 132 of the expandable continuous sealing ring 130 may not be in contact with the inner surface 15 of the tubing string 1, at this stage of the expansion process, namely at the end of the plug setting process. The prominent external surface 131 of the first section of the expandable continuous sealing portion 130 and the radial gap 133 underneath may define a radial thin section. The radial thin section may have a radial thickness between 0.02 to 0.4 inches (0.5 to 10 mm). The radial thin section may include a material capable of deforming radially, elastically with or without plastic deformation, between 1% and 30% relative to an original configuration of the material. One reason for the positioning of the cavity 133 under the external prominent surface 131, may be to keep deformation possibility once the external prominent surface 131 comes in contact with the inner surface 15. Therefore, the contact force between the expandable continuous sealing ring 130 and inner surface 15, as depicted with arrow 140, may be limited during the plug setting process. The contact force between the anchoring devices 74 and the inner surface 15 of the tubing string 1, as depicted with arrows 141, may be important relative to the contact force 140. A potential reason for this force relationship, 140 over 141, may be the focus during the plug setting process to transmit the maximum of the setting force, coming from the setting tool and toolstring 10, towards the anchoring devices 74. It could be an operation goal to focus the majority of the available setting force towards the anchoring of the anchoring devices 74, and therefore enhance the stability of the expandable gripping ring 161 relative to the tubing string 1. The cavity 133 may act as a radial gap for the expansion of the expandable continuous sealing ring 130 giving the ability to adjust the contact surfaces 131 and 15, independently of typical well conditions, such as dimensional variations of the inner diameter or shape of the tubing string, irregularities in surface 15 conditions, presence of debris within the tubing string 1 and inside the well fluid 2. The cavity 133 may compensate for operation variations while possibly ensuring a contact between surface 131 with surface 15, and while transmitting as much force 141 as possible to the anchoring devices 74 to ensure an enhanced gripping and stability of the set plug.

Figure 11:
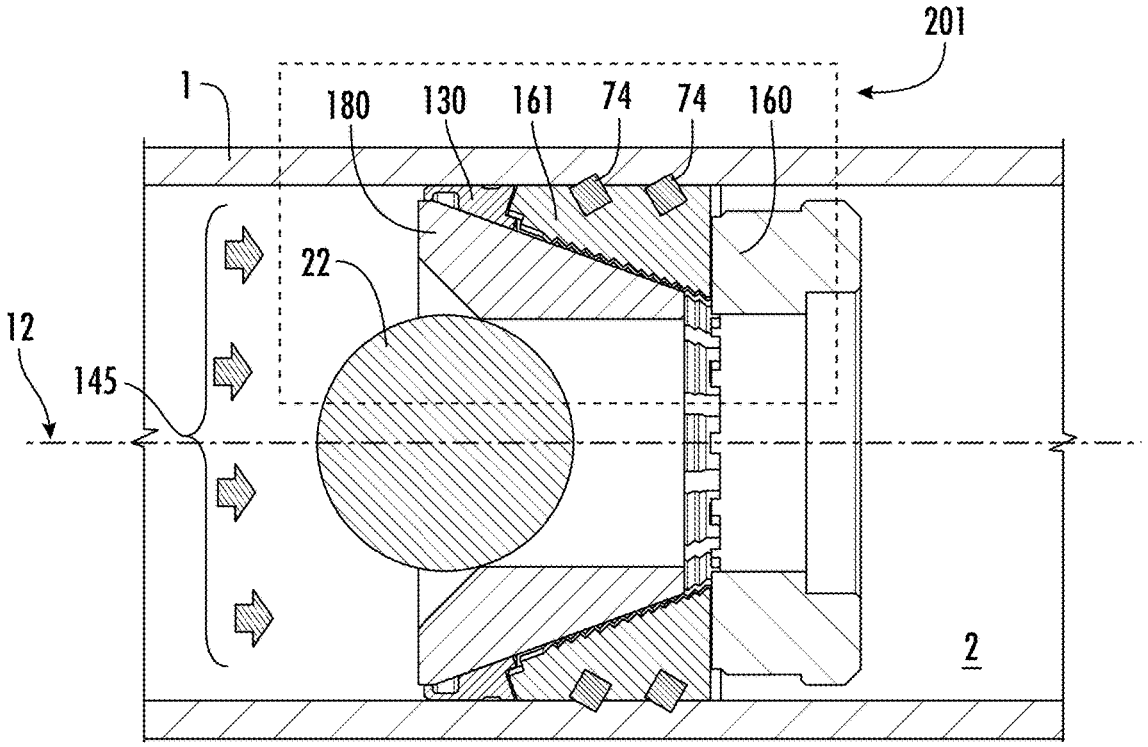
FIG. 11 is a cross-section view of the plug of FIG. 9 after pressurizing well fluid on the front plug components and inducing a longitudinal movement of some front plug components.
Figure 12:
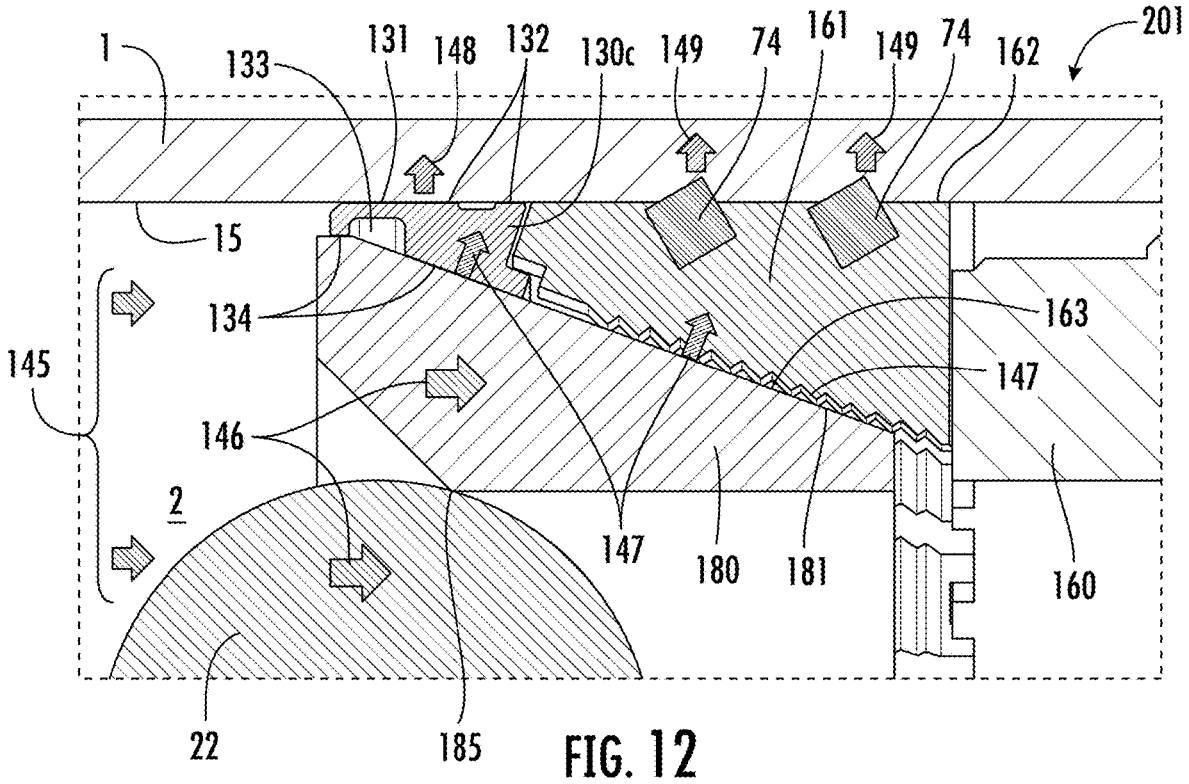
FIG. 12 is a detailed cross-section view FIG. 11.

The influence of the untethered object 22 on the set plug may be further depicted in FIGS. 11-12.

FIG. 11 represents a subsequent step of FIG. 9. FIG. 11 represents depicts a cross-sectional view of the set plug of FIG. 9, with the untethered object 22 landed on the integral locking ring 180, and starting pumping well fluid 2.

The flow of well fluid 2 is represented with arrows 145. After the landing of the untethered object 22 on the integral locking ring 180, the well fluid 2 may be pressurized from surface, typically through pumping activity, which may induce a pressure differential across the set plug, whereby the set plug creates a flow restriction.

Typical pressure differential uphole compared to downhole of the set plug, as on FIG. 10, may reach a range of 1,000 to 20,000 psi [6.9 MPa to 138 MPa]. The set plug may block or divert a portion of the fluid flow 145 and build an over-pressure uphole of the set plug. The rule governing fluid flow and fluid pressure within a tubing string is typically referred as Bernoulli equation, and in case of high flow rates across a limited flow-through area represented as potential gaps remaining between the set plug and the tubing string 1, the pressure build-up is typically referred as Venturi effect. The local created fluid over-pressure P may induce a force F on all exposed surface S, following the formula F=P/S.

FIG. 11 represents the consequence of the forces induced by the flow 145 of well fluid 2, with internal movement of plug items. The detail of item movements and force transmissions will be further depicted in the detailed section 201, further represented in FIG. 12.

FIG. 12 depicts the detailed section 201, as a cross-section view of the set plug of FIG. 10 with the untethered object 22 landed on the integral locking ring 180, with the pressure action 145 of well fluid 2. If compared with detailed section 200 of FIG. 10, the pressure action 145 of well fluid 2 would induce relative movements of parts within the set plug. The parts being the most exposed to the pressure action 145 of well fluid 2 would be the untethered object 22 and the integral locking ring 180, due to their relative exposed surface to well fluid 2 uphole of the set plug. The resultant of the pressure action 45 is represented with arrows 146 on the untethered object 22 and the integral locking ring 180. The force resultant 146 would cause a longitudinal movement of those two parts within the plug, relative to the expanded gripping ring 161, which is anchored to the inner surface 15 of the tubing string 1, through the anchoring devices 74. The untethered object 22 and the integral locking ring 180 may follow the same longitudinal movement induced by force resultant 146, as both parts are in a non- or limited-sliding contact with each other's through the seating contact surface 185. The longitudinal movement of the integral locking ring 180 may induce and transmit the force resultant 146 to the expandable continuous sealing ring 130 and to the expandable gripping ring 161, through the flared surface 181 of the integral locking ring 180. The corresponding flared inner flared surface 134 of the expandable continuous sealing ring 130 and inner flared surface 163 of the expandable gripping ring 161 may transmit through a sliding contact a radial force, represented as arrow 147 for both the expandable continuous sealing ring 130 and for the expandable gripping ring 161. The radial force 147 may compress the expandable continuous sealing ring 130 further towards the inner surface 15 of the tubing string 1. The further compression force is symbolized with arrow 148. The compression force 147 may continue deforming the section of the expandable continuous sealing ring 130 including the prominent external surface 131 and therefore may collapse further the cavity 133 or may reduce its radial gap. The radial deformation may continue to bring the external surface 132 of the expandable continuous sealing ring 130 towards the contact with the inner surface 15 of the tubing string 1. The represented deformed expandable continuous sealing ring 130 may be referred as 130*c*, as the expandable continuous sealing ring in its well fluid pressure deformed status. Simultaneously with the radial deformation of the expandable continuous sealing ring 130, the radial force 147 may continue expanding the expandable gripping ring 161 with an additional penetration of the anchoring devices 74 inside the inner surface 15 of the tubing string 1. The further expansion of the expandable gripping ring 161 is represented with arrows 149 depicting the further radial force being transmitted towards the tubing string 1. The gap 142, as shown in FIG. 10, between the surfaces 162 and 15 may be closed at a point of the operation, when a sufficient pressure differential of well fluid 2 is achieved. Further pressure 145 of well fluid 2 may be applied, in a range between 1,000 to 20,000 psi [6.9 MPa to 138 MPa], with similar force transmission. Further longitudinal force 146 may continue to induce radial forces 147 and further radial forces 148 and 149 to the inner surface 15 of the tubing string 1. Additional radial forces 148 on the expandable continuous sealing ring 130 may improve the fluid isolation or sealing of well fluid 2, uphole relative to downhole of the set plug. Additional radial forces 149 on the expandable gripping ring 161 may improve the anchoring of the plug and therefore may enhance the stability of the set plug within the tubing string 1, when under pressure differential.

Figure 13:
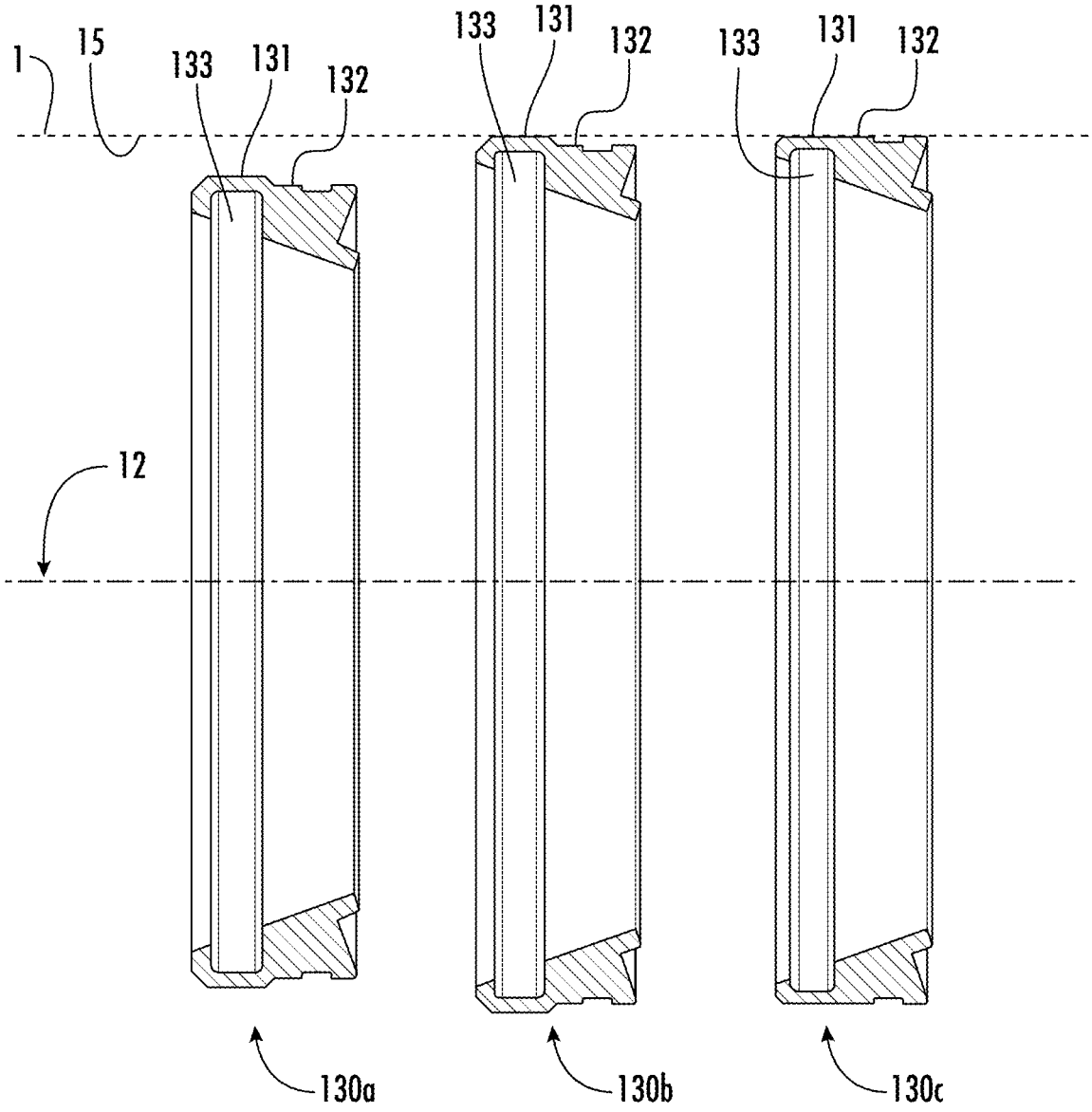
FIG. 13 are cross-section views of the expandable continuous sealing ring, at different stages of expansion.

FIG. 13 represents cross-section views of the expandable continuous sealing ring 130 in three expansion or deformation status. View 130*a* represents the ring 130 in its undeformed or run-in-hole status. View 130*b* represents the ring 130 in its deformed status after the plug is set within the tubing string 1. View 130*c* represents the ring 130 in its deformed and compressed status, after being solicitated by the pressure of well fluid 2. The three status 130*a*, 130*b* and 130*c* are possible status of the expansion process of the expandable continuous sealing ring 130 within a typical operation. The three statuses represent an illustration of possible relationship and movement of the contact surfaces relative to the inner surface 15 of the tubing string 1.

Figure 14:
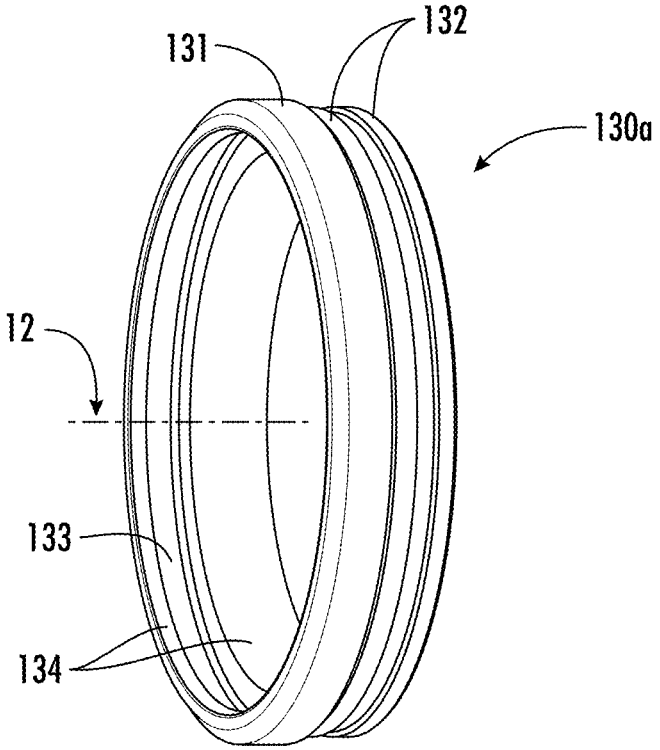
FIG. 14 is an isometric cross-section view of the expandable continuous sealing ring.

FIG. 14 represents an isometric view of the expandable continuous sealing ring 130 in the unexpanded 130*a* status. Visible are the external surfaces 131 and 132, the internal surface 134 and the cavity 133.

Figure 15:
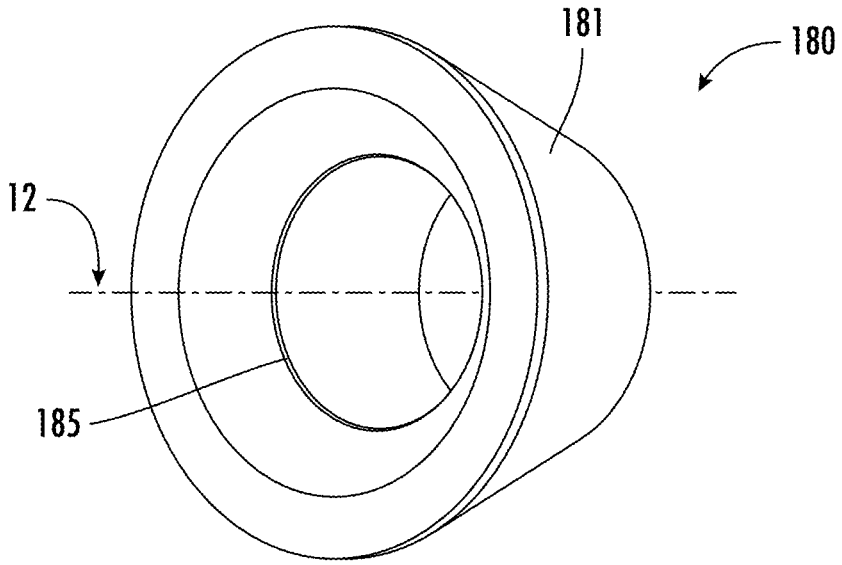
FIG. 15 is an isometric view of the integral locking ring.

FIG. 15 represents an isometric view of the integral locking ring 180. Visible are the seating surface 185, for the untethered object 22, and the flared outer surface 181, represented as a conical surface.

Figure 16:
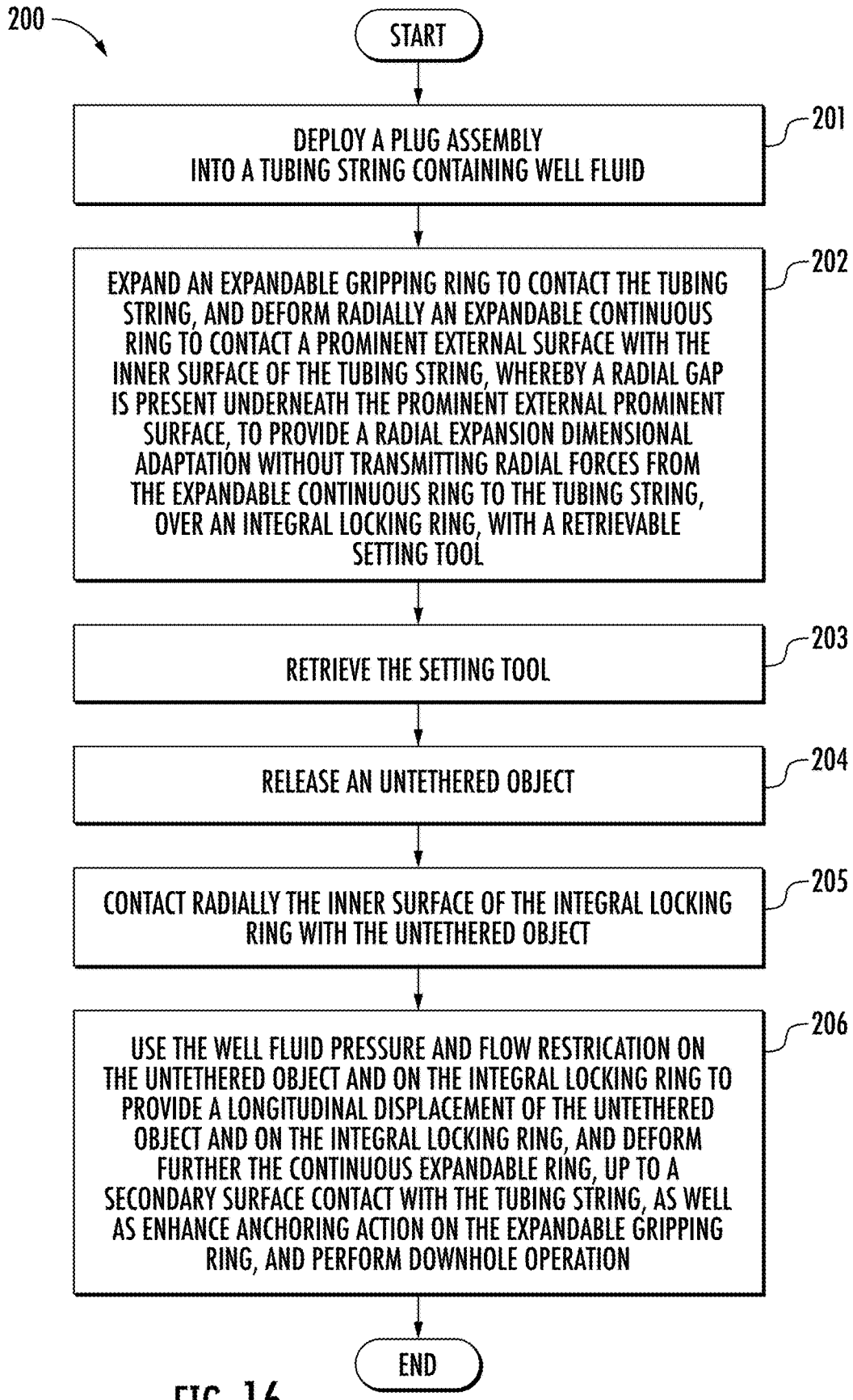
FIG. 16 is a flow diagram representing a technique sequence of deploying a plug assembly, whereby the plug assembly includes a radial and collapsible gap within the continuous expandable sealing ring.

FIG. 16 represents a technique sequence 200, which includes major steps depicted in FIG. 7 to FIG. 12.

Step 201 corresponds to the deployment of a plug assembly (130, 180, 161, 160) into the tubing string (1) containing well fluid (2). During step 202, the plug assembly is expanded radially, including the radial expansion of the expandable gripping ring (161) to contact at least one point of the inner surface (15) of the tubing string (1). During the same step 202, the expandable continuous sealing ring (130) is expanded and deformed radially, to contact a prominent external surface (131) with the inner surface (15) of the tubing string (1), whereby a radial gap (133) is present underneath the prominent external surface (131) to provide a radial expansion dimensional adaptation, without transmitting radial forces between the expandable continuous sealing ring (130) and the tubing string (1). In step 202, the expansion and deformation occurs over an integral locking ring (180) with the action of a retrievable setting tool. Then, during step 203, the retrievable setting tool, is retrieved. Further during step 204, an untethered object (22) is released either from the setting tool or from surface. Then, during step 205, the untethered object (22) contacts radially the inner surface of the integral locking ring (180). Then, during step 206, the well fluid (2) pressure and flow restriction is used on the untethered object (22) and integral locking ring (180) to act as a force to provide a longitudinal displacement of the untethered object (22) and integral locking ring (180) relative to the expandable gripping ring (161). Further in step 206, the force and displacement are used to deform further the expandable continuous seal ring (130), up to a secondary external surface (132) contacts inner surface (15) of the tubing string (1), as well as enhance the anchoring action on the expandable gripping ring (161). This isolation state allows performing a downhole operation inside the well.

In some embodiments, the method may comprise the step of diverting a portion of the well fluid outside the tubing string, or the step of sealing a portion of the well fluid inside the tubing string with the plug assembly. The method may comprise the step of dissolving at least one component of the plug assembly, the cup, or the untethered object.

Figure 17:
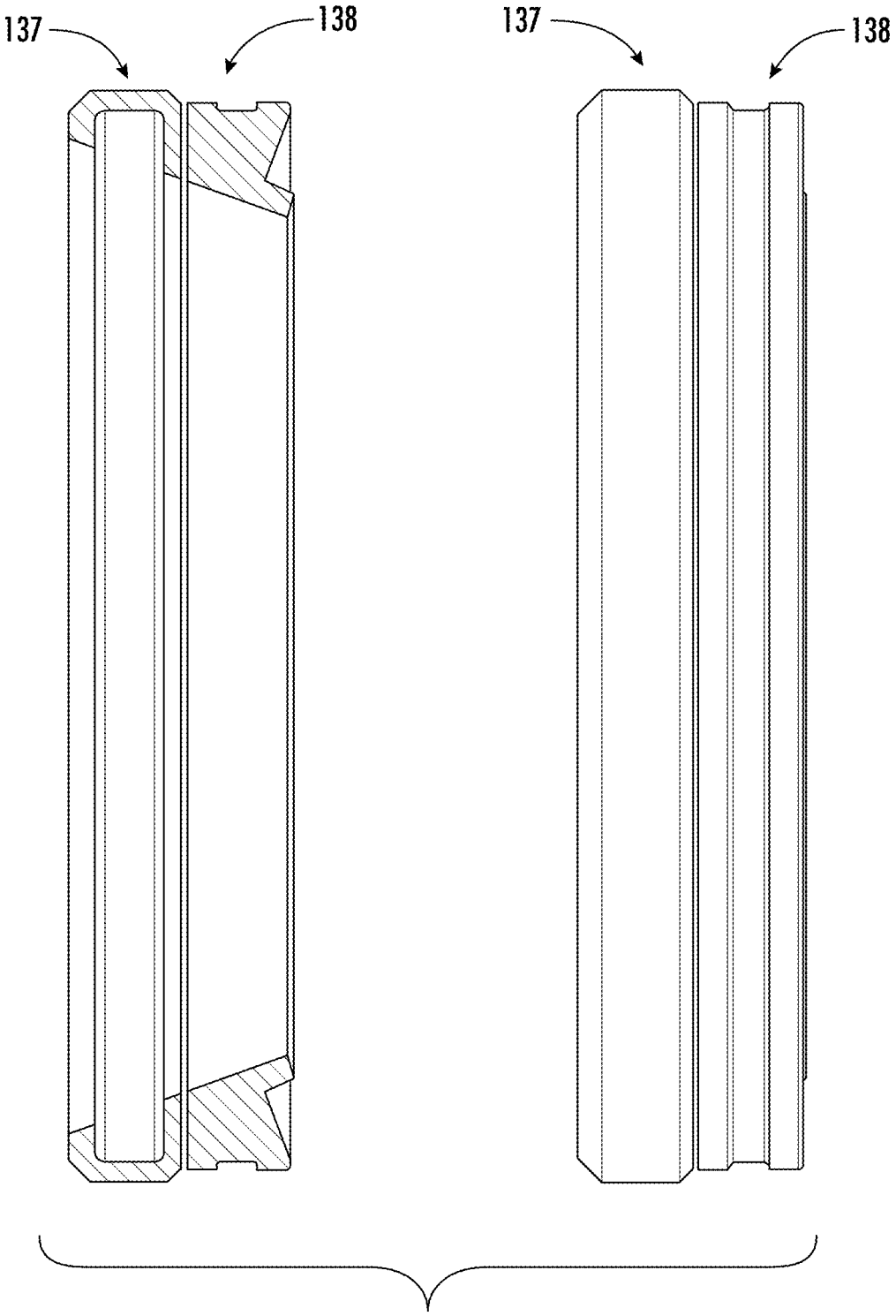
FIG. 17 is two views, cross-section and isometric, of an alternative to continuous expandable sealing ring, including two portions instead of one.

FIG. 17 represents two views of an alternative to the continuous expandable sealing ring 130. As displayed, the one part 130 could be divided in two portions 137 and 138. The portion 137 would include the prominent external surface 131 and the radial gap 133, while the portion 138 would include the secondary external surface 132. Similar functions and operations may be achieved with a two-parts continuous expandable sealing ring, compared to the one-part 130 used to describe the invention.

What is claimed is:

1. A method comprising:

deploying a plug assembly into a tubing string containing well fluid, the plug assembly including:

an expandable assembly, comprising a continuous sealing portion and a gripping portion, an integral locking ring, wherein the expandable assembly includes a flared inner surface, wherein the integral locking ring includes a flared outer surface and a seating surface, wherein the flared outer surface of the integral locking ring is contacting the flared inner surface of the expandable assembly, wherein the continuous sealing portion of the expandable assembly includes a first section with a prominent external surface, whereby the first section with the prominent external surface includes a radial gap underneath, and a second section with a second external surface that has a smaller outer diameter than the prominent external surface in an undeformed position, wherein the continuous sealing portion of the expandable assembly is in the undeformed position when the plug assembly is deployed;

expanding the expandable assembly over the flared outer surface of the integral locking ring, whereby the expandable assembly deforms radially until the gripping portion of the expandable assembly contacts at least one point of an internal surface of the tubing string, and until the continuous sealing portion is in a set position in which the prominent external surface of the first section of the continuous sealing portion contacts the internal surface of the tubing string without the second external surface of the continuous sealing portion contacting the internal surface of the tubing string;

releasing an untethered object inside the well fluid of the tubing string with the continuous sealing portion of the expandable assembly in the set position, wherein the untethered object includes an outer surface adapted to couple with the stopping inner seating surface of the integral locking ring;

contacting the untethered object with the stopping inner seating surface of the integral locking ring, after the expandable assembly is deformed radially into the set position;

applying pressure on the untethered object and on the integral locking ring, using the well fluid, inducing forces applied to the plug assembly to cause:

a radial deformation of the continuous sealing portion of the expandable assembly from the set position into a compressed position in which the prominent external surface and the second external surface of the continuous sealing portion contact the internal surface of the tubing string, and a radial reduction of the radial gap underneath the prominent external surface of the continuous sealing portion of the expandable assembly.

2. The method of claim 1, further comprising:

penetrating the internal surface of the tubing string with the gripping portion of the expandable assembly, and diverting a portion of the well fluid outside the tubing string, or sealing a portion of the well fluid inside the tubing string with the plug assembly.

3. The method of claim 1, wherein radially deforming the expandable assembly occurs through plastic deformation of metallic alloy.

4. The method of claim 1, further comprising dissolving at least one component of the plug assembly or the untethered object.

5. The method of claim 1, wherein the expandable assembly includes a continuous sealing ring and a gripping ring that are separate, wherein the continuous sealing ring and the gripping ring are coupled longitudinally through a conical or an annular contact surface, and wherein an inner surface of the continuous sealing ring and an inner surface of the gripping ring form the flared inner surface of the expandable assembly.

6. The method of claim 1, wherein releasing the untethered object inside the well fluid occurs from surface or directly released from the plugging assembly as part of the plug deployment inside the tubing string.

7. A plugging apparatus, for use inside a tubing string containing well fluid, comprising:

a plug assembly including:

an expandable assembly, comprising a continuous sealing portion and a gripping portion, an integral locking ring, wherein the expandable assembly includes a flared inner surface, wherein the integral locking ring includes a flared outer surface and a seating surface, wherein the flared outer surface of the integral locking ring is contacting the flared inner surface of the expandable assembly, wherein the expandable assembly is adapted to be deformed radially, wherein the continuous sealing portion of the expandable assembly includes a first section with a prominent external surface, whereby the first section with the prominent external surface includes a radial gap underneath, and a second section with a second external surface that has a smaller outer diameter than the prominent external surface in an undeformed position, wherein in a set position, the prominent external surface of the continuous sealing portion is configured to contact an internal surface of the tubing string without the second external surface of the continuous sealing portion contacting the internal surface of the tubing string;

an untethered object, wherein the untethered object includes an outer surface adapted to couple with the seating surface of the integral locking ring and, using well fluid pressure, to apply forces to the plug assembly to cause:

a radial deformation of the continuous sealing portion of the expandable assembly from the set position into a compressed position in which the prominent external surface and the second external surface of the continuous sealing portion contact the internal surface of the tubing string, and a radial reduction of the radial gap underneath the prominent external surface of the continuous sealing portion of the expandable assembly.

8. The apparatus of claim 7, wherein the expandable assembly includes a continuous sealing ring and a gripping ring that are separate, wherein the continuous sealing ring and the gripping ring are coupled longitudinally through a conical or an annular contact surface, wherein an inner surface of the continuous sealing ring is adjacent to an inner surface of the gripping ring, and wherein the inner surface of the continuous sealing ring and the inner surface of the gripping ring form the flared inner surface of the expandable assembly.

9. The apparatus of claim 7, wherein the expandable assembly comprises one or more plastically deformable metallic alloys.

10. The apparatus of claim 7, wherein at least one component of the plug assembly or the untethered object comprise a material dissolvable inside the well fluid.

11. The apparatus of claim 7, further comprising a back-pushing ring and a retrievable setting tool, wherein the retrievable setting tool is adapted to displace the back-pushing ring causing the radial deformation of the expandable assembly over the flared outer surface of the integral locking ring from the undeformed position to the set position.

12. The apparatus of claim 11, wherein the retrievable setting tool includes a mandrel and a rod, wherein the mandrel has a surface including one or more of annular, conical, and spherical portions, wherein the mandrel contacts the inner surface of the locking ring with the surface including one or more of annular, conical, and spherical portions, wherein the rod couples to the back-pushing ring with a preset load-shearing device.

13. The apparatus of claim 11, wherein the retrievable setting tool is configured to be retrieved, after the radial expansion of the expandable assembly from the undeformed position to the set position.

14. The apparatus of claim 13, wherein the untethered object is included inside the retrievable setting tool, wherein the untethered object is launched from the retrievable setting tool after the radial expansion of the expandable assembly and before the retrieval of the retrievable setting tool.

15. The apparatus of claim 7, wherein the untethered object is launched from surface.

16. The apparatus of claim 7, wherein the untethered object is a ball, a dart, or a pill.

17. The apparatus of claim 7, wherein the prominent external surface of the first section of the continuous sealing portion of the expandable assembly and the radial gap underneath defines a radial thin section, whereby the radial thin section includes a radial thickness between 0.02 to 0.4 inches.

18. The apparatus of claim 17, wherein the radial thin section includes a material capable of deforming radially, elastically with or without plastic deformation, between 1% and 30% relative to an original configuration of the material.

19. The apparatus of claim 7, wherein the flared outer surfaces on the integral locking ring, as well as the flared inner surface of the expandable assembly include conical surfaces with angles between 2 and 40 degrees.

* * * * *